United States Patent [19]

Terazawa

[11] Patent Number: 5,016,589

[45] Date of Patent: May 21, 1991

[54] THROTTLE CONTROL DEVICE

[75] Inventor: Tadashi Terazawa, Toyota, Japan

[73] Assignee: Aisin Seiki Kabushiki Kaisha, Kariya, Japan

[21] Appl. No.: 472,164

[22] Filed: Jan. 30, 1990

[30] Foreign Application Priority Data

Jan. 31, 1989 [JP] Japan ..... 1-22189

[51] Int. Cl.[5] ..... F02D 11/10

[52] U.S. Cl. ..... 123/399; 123/400

[58] Field of Search ..... 123/361, 399, 400

[56] References Cited

U.S. PATENT DOCUMENTS

| | | | |
|---|---|---|---|
| 4,523,565 | 6/1985 | Omitsu | 123/399 |
| 4,873,957 | 10/1989 | Ueyama et al. | 123/399 |
| 4,892,071 | 1/1990 | Asayama | 123/399 X |
| 4,919,097 | 4/1990 | Mitui et al. | 123/399 |

FOREIGN PATENT DOCUMENTS

| | | | |
|---|---|---|---|
| 0003239 | 1/1989 | Japan | 123/399 |

*Primary Examiner*—Willis R. Wolfe

*Attorney, Agent, or Firm*—Burns, Doane, Swecker & Mathis

[57] ABSTRACT

A throttle control device for controlling an opening of a throttle valve in response to operation of an accelerator operating mechanism includes throttle operating means and first driving means connected to the accelerator operating mechanism and arranged to engage with the throttle operating means for driving the same in a direction to open the throttle valve. The first driving means drives the throttle operating means within a predetermined displacement in response to operation of the accelerator operating mechanism after it engages the throttle operating means. The device further includes biasing means for biasing the throttle operating means in a direction to close the throttle valve, and second driving means for driving the throttle operating means independently of the first driving means. A driving power source is connected to the second driving means. Between the second driving means and the throttle operating means, there is disposed clutch means for taking one of a first position of the throttle operating means engaged with the second driving means and a second position of the throttle operating means disengaged therefrom. Accordingly, even in the case where the driving power source operates abnormally, a certain opening of the throttle valve is ensured, as long as the accelerator operating mechanism is operated continuously.

11 Claims, 4 Drawing Sheets

THROTTLE CONTROL DEVICE

BACKGROUND OF THE INVENTION

1. Field of the Invention

The present invention relates to a throttle control device mounted on an internal combustion engine, and more particularly to a throttle control device which performs various controls such as acceleration slip control, automatic speed control, idling control, automatic speed restriction, and etc. by controlling an opening of a throttle valve with a driving power source such as a motor operated in response to operation of an accelerator operating mechanism, and which is able to stop the control effected by the driving power source at any time if necessary.

2. A throttle valve for use in an internal combustion engine is provided to regulate a mixture of fuel and air in a carburetor, or regulate an intake air flow in an electronic-controlled fuel injection system so as to control the output of the internal combustion engine, and is so structured to gear with an accelerator operating mechanism including an accelerator pedal.

Conventionally, the accelerator operating mechanism has been mechanically connected to the throttle valve, whereas a device for opening and closing the throttle valve, or controlling an opening of the throttle valve by driving means gearing with a driving power source such as a motor in response to operation of the accelerator pedal has been recently proposed. For example, Japanese Patent Laid-open Publication No. Sho 55-145867 discloses a device which is provided with a step motor connected to a throttle valve and which is arranged to drive the step motor in response to depression of the accelerator pedal.

For such a device, Japanese Patent Laid-open Publication No. Sho 59-153945 discloses various conventional countermeasures employed in the case where an electronic-controlled actuator falls into an incontrollable condition. For instance, a throttle shaft is disengaged from the electronic-controlled actuator by an electromagnetic clutch to return the throttle valve to its closed position by means of a return spring. In the above Publication (59-153945), the countermeasures have been proposed by reason that the conventional device has no driving means for opening and closing the throttle valve after the control effected by the actuator stops, so that it is unable to drive a vehicle to a certain place for repairs. Accordingly, there is disposed between a throttle shaft and a rotary shaft rotating in response to depression of an accelerator pedal, an electromagnetic clutch which disengages the shafts from each other when it is energized, while it engages the rotary shaft with the throttle shaft when it is deenergized, and there is provided a control circuit which detects the abnormality of the control operation of the electronic-controlled actuator and drives a relay to stop the power supply to the actuator and the electromagnetic clutch, whereby the throttle shaft is mechanically connected to the accelerator pedal through the electromagnetic clutch when the actuator falls into the incontrollable condition.

According to the above Publication (59-153945), the incontrollable condition of the electronic-controlled actuator is detected by another control circuit, and the power supply to the actuator and the electromagnetic clutch is stopped by that control circuit. After the above-described control stops, the rotary shaft mechanically connected to the accelerator pedal is engaged with the throttle shaft through the electromagnetic clutch. Further, regarding to the operation, it is described that since the motor generates no driving torque under the condition that the control effected by the actuator stops, it is less liable to interfere with the opening and closing operation of the throttle valve in response to depression of the accelerator pedal, with only slight force applied comparing with a depressing force of the accelerator pedal. That is, the accelerator pedal is maintained to be engaged with the actuator even after the transition to the direct throttle control by the accelerator pedal.

However, the electromagnetic clutch provided in the above-described conventional device is large in size and high in cost. In such an extreme situation that not only the electronic-controlled actuator is incontrollable, but also the control circuit is inoperative, the throttle valve might be driven continuously to open due to the radio wave noise or the like, for example. Further, in the case where a foreign body is jammed between a rotor and a stator of the motor to cause the locked condition, the throttle valve might be held under the opened condition. In this case, even if switch means is provided for stopping the power supply to the electromagnetic clutch so as to engage the throttle shaft with the accelerator pedal, there is no means for operating the throttle valve to be closed against the throttle shaft driven by the actuator, so that it is difficult to ensure a desired opening of the throttle valve, i.e. a desired throttle position.

SUMMARY OF THE INVENTION

Accordingly, it is an object of the present invention to provide a throttle control device which may disengage a driving power source from a throttle valve and permit the throttle valve to be rotated in response to operation of an accelerator operating mechanism, even in the case where the driving power source operates abnormally.

In accomplishing the above and other objects, a throttle control device according to the present invention, which controls an opening of a throttle valve disposed in a throttle body and rotatably supported by a throttle shaft mounted thereon, in response to operation of an accelerator operating mechanism, comprises throttle operating means connected to the throttle valve for opening and closing the throttle valve, first driving means connected to the accelerator operating mechanism and arranged to engage with the throttle operating means for driving the throttle operating means in a direction to open the throttle valve. The first driving means drives the throttle operating means within a predetermined displacement in response to operation of the accelerator operating mechanism when the first driving means is engaged with the throttle operating means. The throttle control device further comprises biasing means mounted on the throttle body for biasing the throttle operating means in a direction to close the throttle valve, second driving means for driving the throttle operating means in a direction to open and close the throttle valve independently of the first driving means, a driving power source connected to the second driving means for driving the second driving means in response to operation of the accelerator operating mechanism at least, and clutch means disposed between the throttle operating means and the second driving means for selectively taking one of a first position of the throttle operating means engaged with the second driving means and a second position of the throttle operating means disengaged therefrom.

The throttle control device structured as noted above is mounted on an internal combustion engine, for instance. In the initial position where the accelerator operating mechanism is inoperative, the throttle operating means is disengaged from the second driving means. When the operation of the internal combustion engine is initiated, the throttle operating means is engaged with the second driving means by the clutch means to fall into such a condition that the throttle operating means and the second driving means are movable together. Consequently, the second driving means is driven by the driving power source in response to operation of the accelerator operating mechanism, so that the throttle valve is opened and closed through the throttle operating means. The driving power source may drive the second driving means to open and close the throttle valve, irrespective of the accelerator operating mechanism under the above-described condition, so that various controls such as acceleration slip control and automatic speed control are carried out by properly controlling the driving power source.

In abnormal operation of the driving power source, for instance, the second driving means is disengaged from the throttle operating means by the clutch means. In this case, the first driving means comes into engagement with the throttle operating means to drive the same, if the accelerator operating mechanism is operated more than a certain amount. As a result, as long as the accelerator operating mechanism is operated continuously, a predetermined throttle position or throttle valve opening is ensured, whereby the operation of the internal combustion engine is continued.

BRIEF DESCRIPTION OF THE DRAWINGS

The above stated objects and following description will become readily apparent with reference to the accompanying drawings, wherein like reference numerals denote like elements, and in which.

DESCRIPTION OF THE PREFERRED EMBODIMENTS

Figure 1:
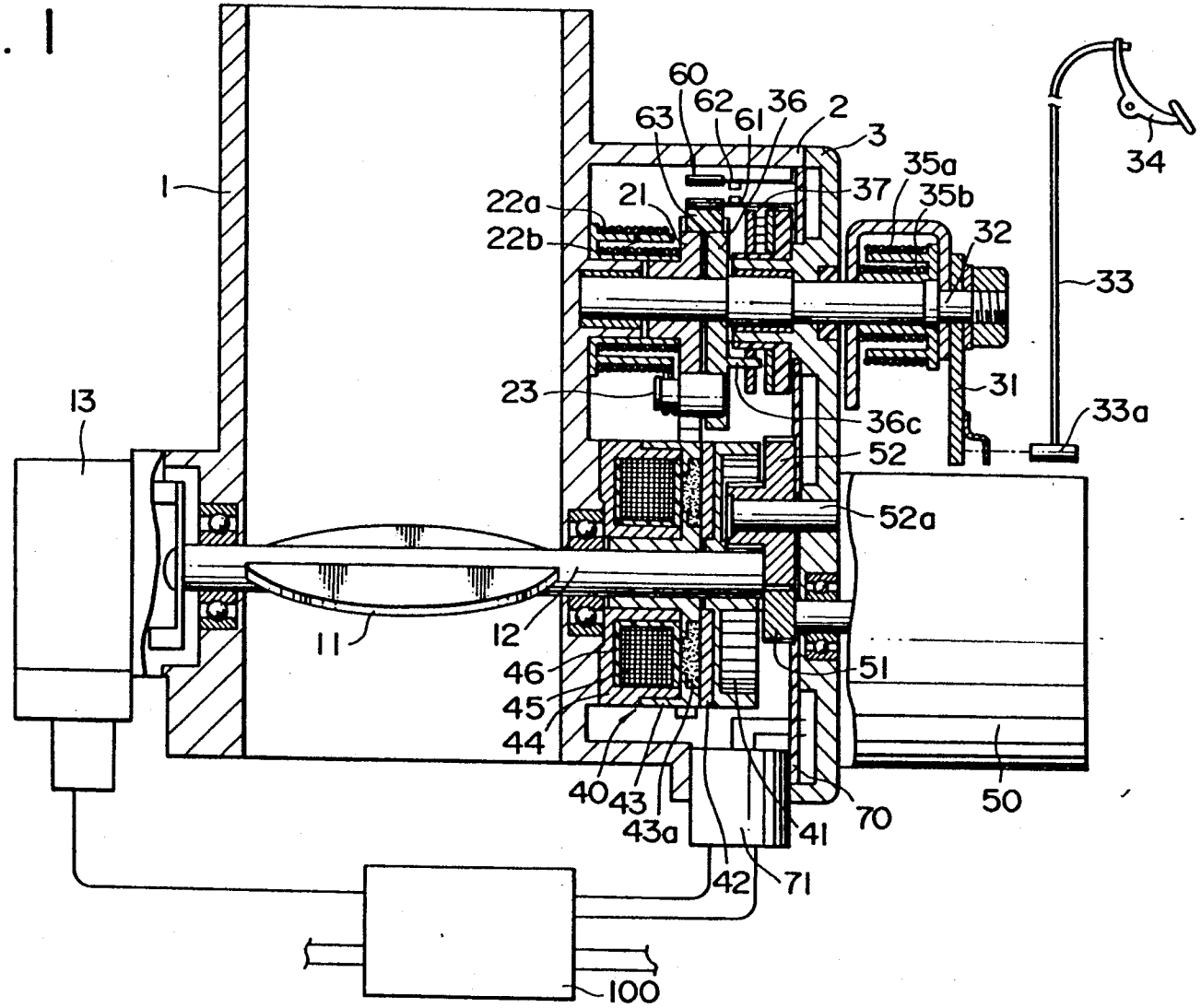
FIG. 1 is a sectional view of a throttle control device according to an embodiment of the present invention.

Referring to FIG. 1, there is illustrated a throttle control device according to an embodiment of the present invention, wherein a throttle valve 11 is disposed in an intake duct of a throttle body 1 of an internal combustion engine (not shown) and rotatably supported by a throttle shaft 12. A case 2 is integrally formed with a side wall of the throttle body 1 which supports one end of the throttle shaft 12, and a cover 3 is attached to the case 2. A part of components constituting the throttle control device of the present embodiment is received in a chamber defined by the side wall of the throttle body 1, the case 2 and the cover 3. Further, a throttle sensor 13 is mounted on a side wall of the throttle body 1 which is opposite to the case 2 and supports the other end of the throttle shaft 12.

The throttle sensor 13 is connected to the throttle shaft 12 and includes a detector for detecting an opening of the throttle valve 11 or a rotational angle of the throttle shaft 12. The rotational angle of the throttle shaft 12 is converted into electric signals, i.e., an idle switch signal and a throttle position signal which are fed to an electronic controller 100 (hereinafter simply referred to as controller 100). In the internal combustion engine having an electronic-controlled fuel injection system (not shown), the intake air flow supplied into a cylinder of the engine through the intake duct is regulated by the throttle valve 11 in response to the output of the controller 100 as described later.

A movable yoke 43 is connected to the other end of the throttle shaft 12, and the throttle valve 11 is so structured to rotate together with the movable yoke 43. The movable yoke 43 is formed of a circular-dished magnetic substance provided in the center thereof with a cylindrical portion secured to the throttle shaft 12 and provided with external teeth formed on its outer peripheral surface. This movable yoke 43 is fitted to a fixed yoke 44 which is formed of a magnetic substance similar in shape to the movable yoke 43, with a predetermined gap, and under the condition that respective opening ends of the movable and fixed yokes 43, 44 confront each other and respective side walls and cylindrical portions thereof are overlapped each other in the axial direction. The fixed yoke 44 is fixedly attached to the throttle body 1, and a coil 45 wound around a bobbin 46 formed of non-magnetic substance is received in a space defined between the cylindrical portion and the side wall of the fixed yoke 44. A friction member **43*a* formed of an annular non-magnetic substance is embedded in the bottom of the movable yoke 43 around the throttle shaft 12, and a driving member 41 corresponding to the second driving means of the present invention is disposed in parallel spaced relationship with the friction member 43*a* through a clutch plate 42 formed of an annular magnetic substance. Thus, an electromagnetic clutch mechanism 40** corresponding to the clutch means of the present invention is constituted.

The driving member 41 is formed of a circular-dished body having a cylindrical portion in the center thereof, and this cylindrical portion is rotatably mounted on the throttle shaft 12. The driving member 41 is provided at the inner peripheral surface of its side wall with internal teeth which mesh with external teeth formed on a small-diameter portion of a gear 52 which is described later. The clutch plate 42 is connected to the bottom of the driving member 41 through leaf springs (not shown). The clutch plate 42 is biased toward the driving member 41 by the leaf springs and is positioned away from the movable yoke 43 when the current is not fed to the coil 45.

The gear 52 meshing with the driving member 41 is formed of a stepped cylindrical body having a small-diameter portion and a large-diameter portion, which are provided with external teeth respectively. The gear 52 is rotatably mounted on a shaft **52*a* fixed to the cover 3. A motor 50 corresponding to the driving power source of the present invention is attached to the cover 3, and a shaft of the motor 50 is rotatably supported in parallel with the shaft 52*a*. A gear 51 is fixed to the tip of the shaft of the motor 50 and so arranged to mesh with the external teeth of the large-diameter portion of the gear 52. According to the present embodiment, a step motor is employed as the motor 50 and controlled by the controller 100. Further, as the motor 50**, a motor of a different type such as a DC motor may be employed.

Thus, when the motor 50 is driven to rotate the gear 51, the gear 52 is rotated around the shaft 52*a*, so that the driving member 41 having the internal teeth meshing with the gear 52 is rotated around the throttle shaft 12 together with the clutch plate 42. If the current is not fed to the coil 45, the clutch plate 42 is positioned away from the movable yoke 43 by the biasing force of the leaf springs (not shown). Namely, in this case, the movable yoke 43, the throttle shaft 12 and the throttle valve 11 are in a freely rotatable condition irrespective of the rotating movement of the driving member 41. When the movable yoke 43 and the fixed yoke 44 are excited, the clutch plate 42 is attracted toward the movable yoke 43 by an electromagnetic force against the biasing force of the leaf springs. Thereby, the clutch plate 42 comes into frictional engagement with the movable yoke 43 through the friction member 43*a*, so that the clutch plate 42 and the movable yoke 43 are rotated together. In this case, therefore, the driving member 41, the clutch plate 42, the movable yoke 43, the throttle shaft 12 and the throttle valve 11 are driven by the motor 50 through the gears 51, 52 to rotate as one body.

An accelerator shaft 32 is rotatably mounted on the throttle body 1 and the cover 3 in parallel with the throttle shaft 12, and projects out of the cover 3. An accelerator link 31 forming a rotary lever is secured to the projecting end of the accelerator shaft 32, and a pin 33*a* fixed to one end of an accelerator cable 33 is engaged with the tip of the accelerator link 31. With return springs 35*a*, 35*b* connected to the accelerator link 31, the accelerator link 31 and the accelerator shaft 32 are biased in a direction to close the throttle valve 11. The other end of the accelerator cable 33 is connected to an accelerator pedal 34 to constitute the accelerator operating mechanism according to the present invention, in which the accelerator link 31 and the accelerator shaft 32 rotate about the axis of the accelerator shaft 32 in response to depression of the accelerator pedal 34.

Figure 2:
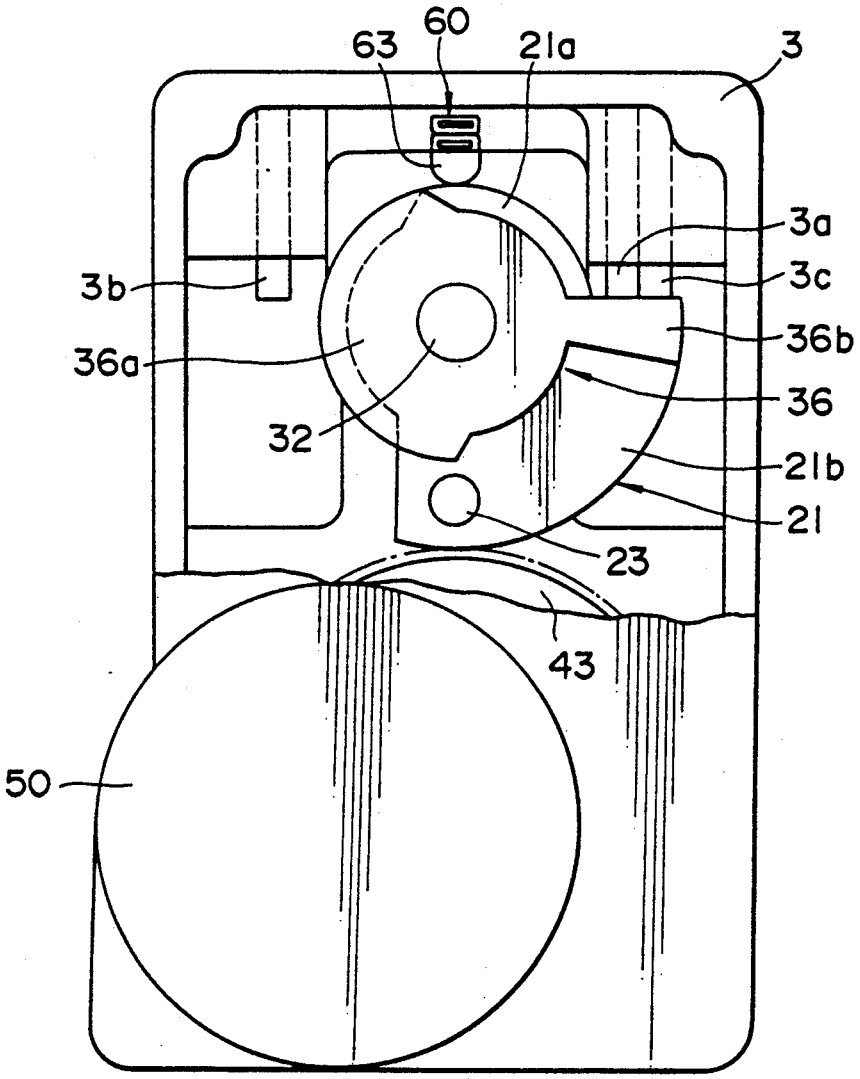
FIG. 2 is a side view, partly in cross section, of the throttle control device of the embodiment of the present invention.

A first rotating member 36 formed of a plate is secured to the accelerator shaft 32 between the throttle body 1 and the cover 3. In parallel with the first rotating member 36, a second rotating member 21 formed of a plate is rotatably mounted on the accelerator shaft 32. The second rotating member 21, a plan view of which is shown in FIG. 2, has a disc portion 21*a* with the center thereof rotatably mounted on the accelerator shaft 32 and a sector portion 21*b* radially extending therefrom. The outer peripheral surface of the sector portion 21*b* is provided with external teeth, which is arranged to mesh with the external teeth formed on the movable yoke 43. Accordingly, if the movable yoke 43 is rotated in response to rotation of the second rotating member 21, the throttle valve 11 and the throttle shaft 12 secured to the movable yoke 43 are rotated. Thus, the second rotating member 21 constitutes the throttle operating means of the present invention along with the movable yoke 43.

As to the second rotating member 21, a substantial half of a peripheral portion of the disc portion 21*a* is formed to have a large diameter, and the remaining portion is formed to have a small diameter as shown in FIG. 2, whereby the second rotating member 21 forms an end cam with the outer peripheral surface of the disc portion 21*a*. One radial side of the sector portion 21*b* confronts a stopper 3*a* provided on the cover 3, and the other side confronts a stopper 3*b* provided also on the cover 3, so that the rotation of the second rotating member 21 is restricted by these stoppers 3*a*, 3*b*. A pin 23 is fixed to the sector portion 21*b* of the second rotating member 21. The sector portion 21*b* is biased toward the stopper 3*a* by a biasing force of return springs 22*a*, 22*b* connected to the pin 23, as shown in FIG. 1. Namely, the second rotating member 21 is biased in a direction to close the throttle valve 11 by the biasing force of the return springs 22*a*, 22*b* corresponding to the biasing means of the present invention.

The first rotating member 36 constitutes the first driving means of the present invention. The first rotating member 36, a plan view of which is shown in FIG. 2, has a disc portion 36*a* with the center thereof secured to the accelerator shaft 32 and an arm portion 36*b* radially extending therefrom. A substantial half of the disc portion 36*a* on the side of the arm portion 36*b* is formed to have a small diameter, and the remaining portion is formed to have a large diameter, whereby the first rotating member 36 forms an end cam with the outer peripheral surface of the disc portion 36*a*. One radial side of the arm portion 36*b* confronts a stopper 3*c* provided on the cover 3, and the other side confronts the pin 23 of the second rotating member 21. Namely, it is so arranged that when the first rotating member 36 is rotated clockwise in FIG. 2, the arm portion 36*b* comes into contact with the pin 23 of the second rotating member 21, and then the first rotating member 36 and the second rotating member 21 are rotated together thereafter. Further, as shown in FIG. 1, an engaging projection 36*c* extends from the arm portion 36*b* in the axial direction of the accelerator shaft 32.

FIG. 2 shows the condition in which the first rotating member 36 and the second rotating member 21 are at their initial positions, and the first rotating member 36 is biased by the biasing force of the return springs 35*a*, 35*b* to have the arm portion 36*b* come into contact with the stopper 3*c*. Then, when the driving member 41 is engaged with the movable yoke 43 through the clutch plate 42, the throttle valve 11 is rotated by the motor 50. Even if the controller 100 or the motor 50 gets out of order, with the electromagnetic clutch mechanism 40 deenergized and the accelerator pedal 34 depressed in excess of a predetermined amount, the first rotating member 36 and the second rotating member 21 are rotated together with the arm portion 36*b* abutted on the pin 23, so that the throttle valve 11 is made open.

An accelerator sensor 37 is mounted on a bearing portion of the cover 3 for supporting the accelerator shaft 32. The accelerator sensor 37 is of a well-known structure having a member formed of a thick film resistance and a brush which confronts the member and is arranged to come into engagement with the engaging projection 36*c* of the first rotating member 36, and detects the rotational angle of the accelerator shaft 32 rotating together with the first rotating member 36 in response to depression of the accelerator pedal 34. The accelerator sensor 37 is electrically connected to a printed wiring board 70 interposed between the case 2 and the cover 3. The printed wiring board 70 is electrically connected to the controller 100 through a connector 71 which is fixed to the case 2.

Further, a limit switch 60 is mechanically and electrically connected to the printed wiring board 70 and arranged to be actuated in response to the rotation of the second rotating member 21 and the first rotating member 36. The limit switch 60 has a pair of elastic leads 61, 62 provided with a contact respectively to form opposed contacts. A slidable member 63 is secured to the tip of the lead 61. As is apparent from FIGS. 1 and 2, the slidable member 63 is biased by an elastic force of the lead 61 such that the slidable member 63 comes into contact with the outer peripheral surface of each of the second rotating member 21 and the first rotating member 36. Thus, the slidable member 63 is moved following the end cam formed on the first rotating member 36 and that formed on the second rotating member 21, and the contact of the lead 61 is in contact with or separated from the contact of the lead 62 in response to the movement of the slidable member 63. In this connection, FIG. 1 shows the condition where the slidable member 63 is located on the small diameter portion of the first rotating member 36 and that of the second rotating member 21, so that the opposed contacts of the leads 61, 62 are separated from each other. Whereas, FIG. 2 shows the condition in which the slidable member 63 is located on the large diameter portion of the second rotating member 21, so that the opposed contacts of the leads 61, 62 are in contact with each other.

Figure 3:
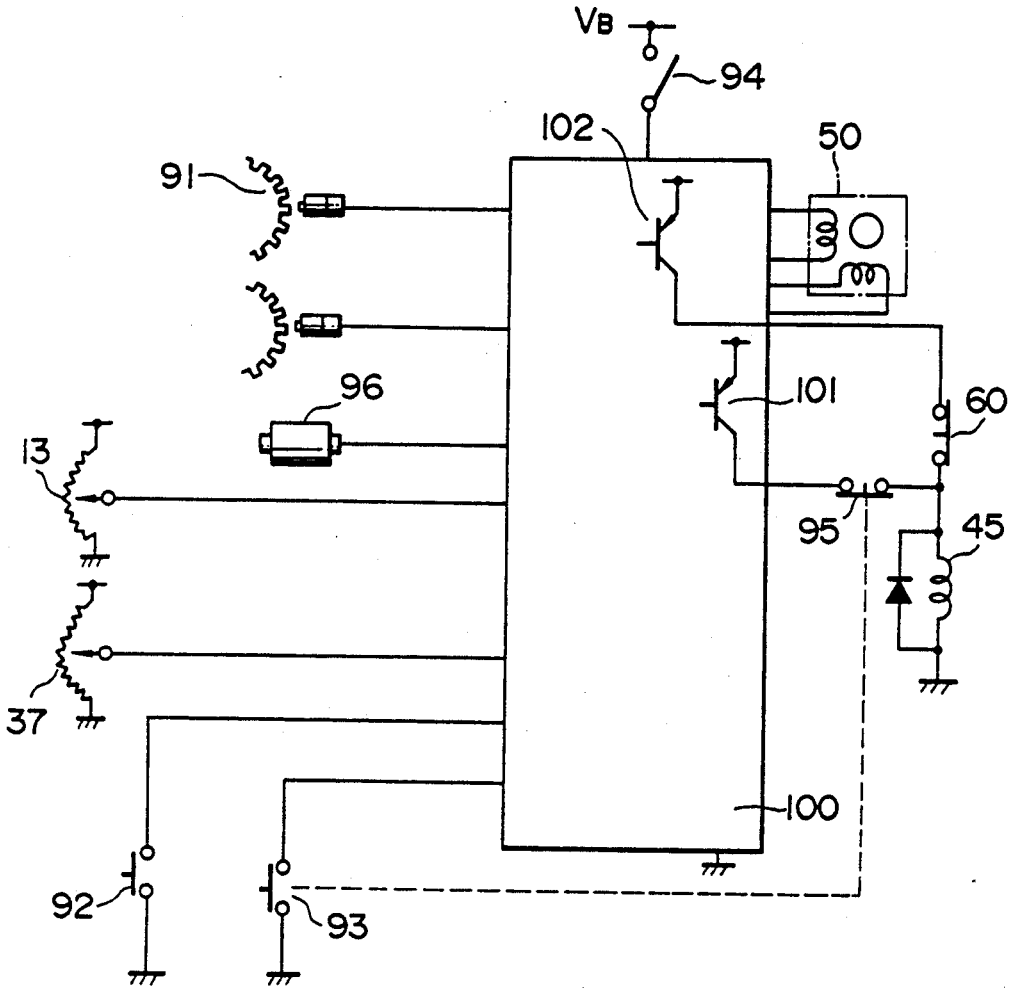
FIG. 3 is a block diagram illustrating the arrangement of the electronic controller shown in FIG. 1.

In FIG. 3, the controller 100 is provided with a control circuit including a microcomputer (not shown) and mounted on a vehicle to receive detection signals from various sensors. The microcomputer includes a central processing unit or CPU (not shown) which controls the operation of the electromagnetic clutch mechanism 40 and that of the motor 50 and provides for various controls such as the acceleration slip control and the automatic speed control, in addition to the control in response to the usual operation of the accelerator pedal, by executing a program stored in a read-only memory or ROM (not shown). The microcomputer further includes a random access memory or RAM (not shown) connected to the CPU, the ROM and input/output ports (not shown) via a common bus (not shown).

The accelerator sensor 37 outputs a signal in response to the depressed amount of the accelerator pedal 34, and this output signal is fed to the controller 100. The output signal of the throttle sensor 13 is also fed to the controller 100, which controls the operation of the motor 50 such as to obtain a desired opening of the throttle valve 11 or a desired throttle position set in accordance with the depressed amount of the accelerator pedal 34. The controller 100 receives various other signals including those fed from the sensors as described felow.

A wheel speed sensor 91 is connected to the controller 100 and provided for the automatic speed control and the acceleration slip control or the like. As the wheel speed sensor 91, a well-known electromagnetic pick-up sensor, a Hall sensor or the like may be employed. While another wheel speed sensor is shown in FIG. 3 in parallel with the wheel speed sensor 91, the wheel speed sensor may be mounted on each of the road wheels, if necessary. An engine speed sensor 96 is connected to the controller 100 and a signal indicating a rotating speed of the internal combustion engine (not shown) is fed thereto. Furthermore, a set switch 92 and a cancel switch 93 for the automatic speed control are connected to the controller 100 and a set signal or a reset signal in response to switching operation of these switches 92, 93 are fed thereto. The cancel switch 93 is operated manually and also in response to depression of a brake pedal (not shown), and so arranged that when the brake pedal is depressed, the cancel switch 93 is closed so that the reset signal is fed to the controller 100.

In the controller 100, there is provided with a switching transistor 101 which controls the current fed to the coil 45 to drive the electromagnetic clutch mechanism 40 mainly at the time of the automatic speed control mode. The switching transistor 101 is connected to the coil 45 through a normally-closed brake switch 95 which is opened in response to depression of the brake pedal. Further, the coil 45 is connected to a switching transistor 102 provided in the controller 100 through the limit switch 60. And, the controller 100 is connected to a power source $V_B$ through an ignition switch 94. In stead of the ignition switch 94, a relay or a transistor rendered to be on when the ignition switch 94 is turned on, or other switching means may be employed. The switching transistor 102 in the controller 100 controls the current fed to the coil 45 of the electromagnetic clutch mechanism 40 and is rendered to be on during the throttle control device operates in its normal condition.

The limit switch 60 structured as noted above has a fail safe function. Namely, in the case where the depressed amount of the accelerator pedal 34 is not more than a predetermined amount, for instance, the depressed amount is substantially naught and the first rotating member 36 is in a condition as shown in FIG. 2, and where the throttle valve 11 is opened and the opening of the throttle valve 11 is increased in excess of a predetermined angle, that is, the second rotating member 21 rotates clockwise in FIG. 2 in excess of a predetermined angle, the slidable member 63 comes into contact with the small diameter portion of the first rotating member 36 and that of the second rotating member 21, so that the opposed contacts of the leads 61, 62 are positioned away from each other. Accordingly, in this case, the current is not fed to the coil 45, so that there is no possibility that the throttle valve 11 is driven by the motor 50, except that the switching transistor 101 is made in its on condition during the automatic speed control, which will be described later.

The operation of the embodiment of the throttle control device structured as noted above will be explained hereinafter. In the case where the accelerator pedal 34 is not depressed, that is, where the throttle valve 11 is fully closed, the first rotating member 36 and the second rotating member 21 are positioned as shown in FIG. 2.

When the ignition switch 94 is turned on, the self-diagnosis is executed in accordance with a diagnosis routine of the program in the controller 100, and when it is determined to be normal, the current is fed to the coil 45 of the electromagnetic clutch mechanism 40. Namely, in a flowchart shown in FIG. 5, Step S1 through S4 are executed, whereas if it is determined to be abnormal at Step S3, the switching transistors 101, 102 are made off at Step S10. In the Step S4, therefore, the fixed yoke 44 and the movable yoke 43 are excited, and the clutch plate 42 is engaged with the movable yoke 43 so that a rotating force of the motor 50 is transmitted to the throttle shaft 12. Thereafter, the throttle shaft 12 is rotated by the motor 50 as long as the abnormal condition, which will be later described in detail, does not take place, so that the opening of the throttle valve 11 is controlled in accordance with the control of the motor 50 by the controller 100.

In a normal travelling mode, when the accelerator pedal 34 is depressed, the accelerator link 31 is rotated against the biasing force of the return springs 35*a*, 35*b* in response to the depressed amount of the accelerator pedal 34. Thus, the first rotating member 36 rotates clockwise in FIG. 2 to maintain the closed condition of the limit switch 60, and the rotational angle of the first rotating member 36 corresponding to the depressed amount of the accelerator pedal 34 is detected by the accelerator sensor 37 which is activated through the engaging projection 36*c* shown in FIG. 1. The detected signal of the accelerator sensor 37 is fed to the controller 100, wherein a predetermined opening of the throttle valve 11 or a predetermined throttle position corresponding to the rotational angle of the first rotating member 36 is obtained. For example, a desired throttle position which corresponds to the rotational angle of the first rotating member 36, i.e. the accelerating position, is set on the basis of the characteristics of "b" or "c" shown in FIG. 4. When the motor 50 is driven to rotate the throttle shaft 12, the signal corresponding to the rotational angle of the throttle shaft 12 is fed from the throttle sensor 13 to the controller 100, and the motor 50 is driven by the controller 100 such that the opening of the throttle valve 11 comes to be substantially equal to the desired throttle position. Thus, the throttle control in response to the depressed amount of the accelerator pedal 34 is carried out, and the engine output corresponding to the opening of the throttle valve 11 is obtained.

During the operation of the throttle valve 11, the first rotating member 36 rotates following the rotation of the second rotating member 21 with a predetermined angle behind, without engaging the first rotating member 36 with the second rotating member 21. Accordingly, the smooth starting and travelling are ensured in response to the operation of the accelerator pedal 34 without producing a mechanical connection between the accelerator pedal 34 and the throttle valve 11. Then, when the accelerator pedal 34 is released from the depression, the accelerator link 31 is returned to the initial position by the biasing force of the return spring 35*a*, 35*b*, so that the throttle valve 11 is also returned to the fully closed position.

Figure 4:
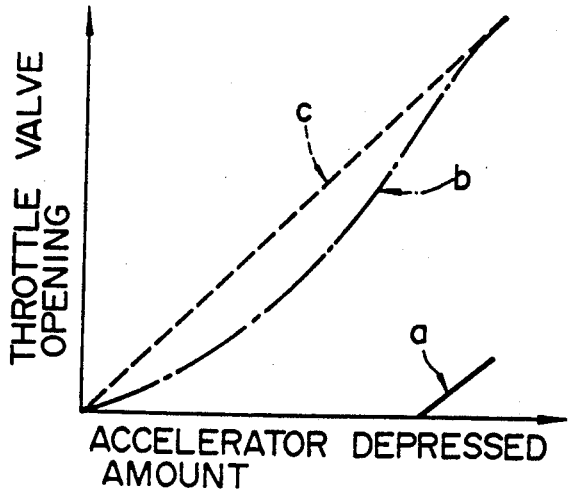
FIG. 4 is a diagram showing the operation of the embodiment of the present invention.

Next will be explained the operation of the throttle control device in the acceleration slip control mode. When a slip of the driving wheel (not shown) in starting or accelerating operation is detected by the controller 100 based upon the output signal of the wheel speed sensor 91 shown in FIG. 3, the normal travelling mode as described above is changed over to the acceleration slip control mode to control the opening of the throttle valve 11 in the following manner. That is, in the controller 100, a desired slip rate of the driving wheel, which ensures the sufficient tractive force and lateral force in the road surface, is calculated, and further a desired throttle position for ensuring the desired slip rate is set. Then, the motor 50 is controlled such that the opening of the throttle valve 11 results in this desired throttle position. Thus, when the slip rate comes to be less than a predetermined value and the desired throttle position exceeds the throttle position set for the normal travelling mode as shown in FIG. 4, the acceleration slip control mode terminates to return to the normal travelling mode. Even during this operation, since the opening of the throttle valve 11 is controlled by the motor 50, there is no possibility that the accelerator pedal 34 receives a so-called pedal shock even when the acceleration slip control mode and the normal travelling mode are changed over to each other.

Next will be explained the operation in the automatic speed control mode, where the controller 100 automatically controls the throttle position to drive the vehicle at a constant speed. Referring to FIG. 3, when a driver operates the set switch 92 for the automatic speed control mode, the switching transistor 101 in the controller 100 is rendered to be on to form a circuit for feeding the current to the coil 45 of the electromagnetic clutch mechanism 40 through the normally closed brake switch 95. Namely, the program proceeds to Steps S5, S8 and S9 in the flowchart shown in FIG. 5. Thereby, even if the accelerator pedal 34 is released and the first rotating member 36 is returned to its initial position, the current continues to be fed to the coil 45, so that the throttle shaft 12 is connected to the motor 50 through the electromagnetic clutch mechanism 40. Then, the desired throttle position is set corresponding to a difference between the vehicle speed detected by the wheel speed sensor 91 and the vehicle speed set by the set switch 92, and the throttle valve 11 is rotated by the motor 50 so as to provide the desired throttle position, whereby the vehicle is driven at the constant speed set by the set switch 92.

When the passing acceleration or the like is needed during the vehicle is travelling at the constant speed in the automatic speed control mode and the accelerator pedal 34 is depressed so that the throttle position corresponding to the depressed amount of the accelerator pedal 34 in the normal travelling mode exceeds the desired throttle position set for the automatic speed control, an override mode is provided, so that the latter desired throttle position is replaced by the throttle position set for the normal travelling mode.

Figure 5:
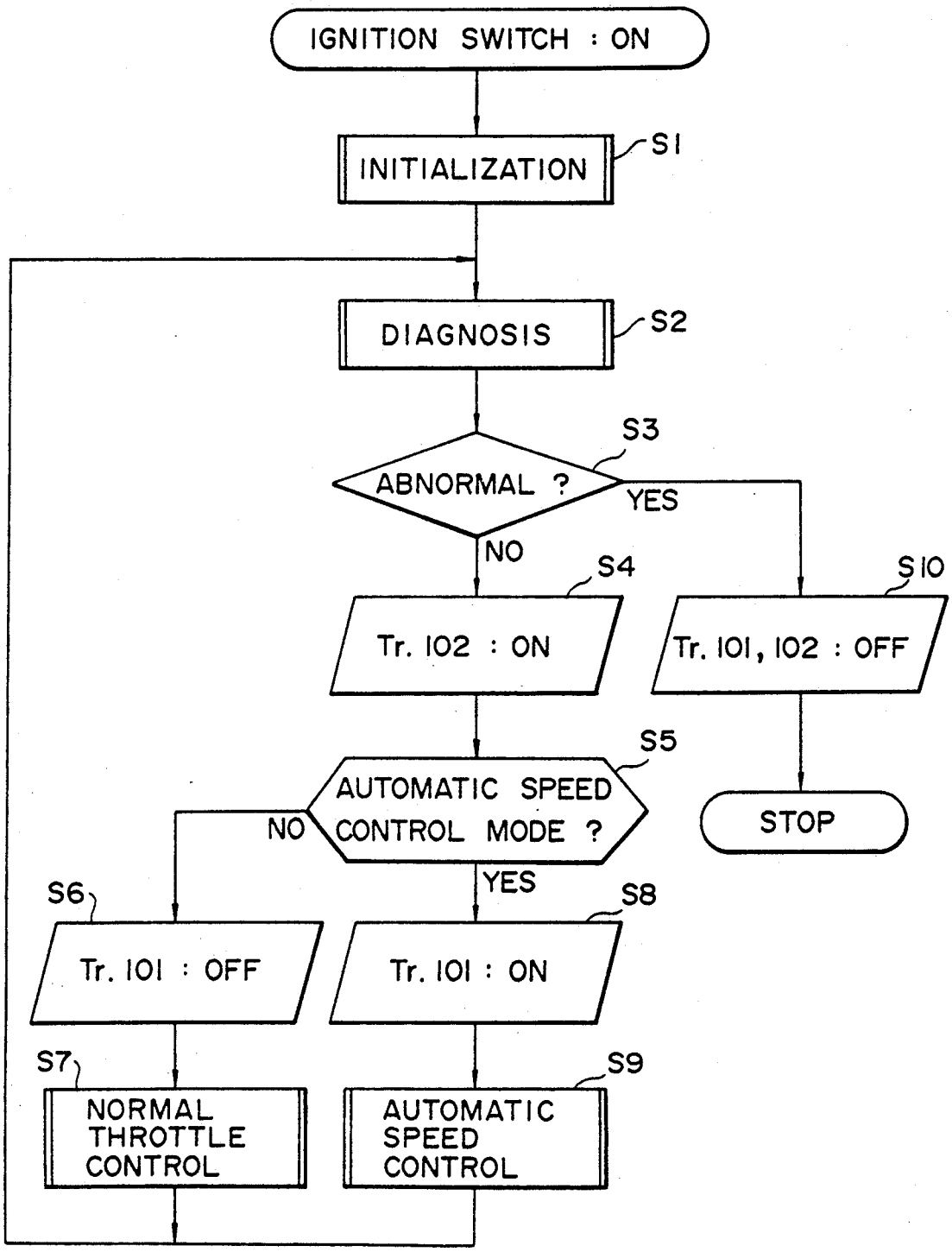
FIG. 5 is a flowchart showing the operation of the control of the electronic controller according to the embodiment of the present invention.

In the case where the vehicle travelling at the constant speed in the automatic speed control mode is to be stopped, the driver operates the cancel switch 93 or depresses the brake pedal to operate the cancel switch 93, so that the switching transistor 101 is rendered to be off to carry out the throttle control in the above-described normal travelling mode. Namely, Steps S6 and S7 of the flowchart in FIG. 5 are executed. Further, even if the switching transistor 101 in the controller 100 is short-circuited in the automatic speed control mode, the brake switch 95 is rendered to be off as long as the brake pedal is operated, so that the movable yoke 43 and the clutch plate 42 are surely positioned away from each other without the current fed to the coil 45 of the electromagnetic clutch mechanism 40, and the throttle valve 11 is returned to the closed position by the biasing force of the return springs 22*a*, 22*b*.

When the opening of the throttle valve 11 and the depressed amount of the accelerator pedal 34 detected by the throttle sensor 13 and the accelerator sensor 37 respectively are less than the respective predetermined value, an idling control mode is provided, so that the motor 50 is driven such as to provide the desired engine speed set in response to the temperature of the cooling water and the running condition of the engine such as a load in the idling control mode. In this condition, therefore, the limit switch 60 is held to be on as shown in FIG. 2.

In the case where the engine speed detected by the engine speed sensor 96 exceeds a predetermined value, a rotational limiter, or a rotational speed restriction mode is provided, wherein the opening of the throttle valve 11 is controlled into a desired throttle position set in accordance with the predetermined value. Further, in the case where the vehicle speed exceeds a predetermined speed, a vehicle speed limiter, or an automatic speed restriction mode is provided, wherein the opening of the throttle valve 11 is controlled into a desired throttle position set in accordance with the predetermined speed.

In the above-described throttle control device, even if the controller 100 makes an erroneous operation caused by a radio wave noise or the like and the throttle valve 11 is rotated in the opening direction irrespective of the operation of the accelerator pedal 34, the throttle valve 11 is returned to the closed position as far as the accelerator pedal 34 is released to its initial position. Namely, referring to FIG. 2, when the movable yoke 43 secured to the throttle shaft 12 is driven to rotate the second rotating member 21 clockwise, the small diameter portion of the disc portion 21*a* of the second rotating member 21 confronts the slidable member 63 of the limit switch 60. Then, if the accelerator pedal 34 is released to its initial position, the first rotating member 36 is returned to its initial position shown in FIG. 2, and the small diameter portion 36*a* confronts the slidable member 63 of the limit switch 60, so that the slidable member 63 comes into contact with both the small diameter portions of the disc portions 21*a*, 36*a*. Thereby, the contact of the lead 61 is positioned away from the contact of the lead 62, and the limit switch 60 is rendered to be off, so that the electromagnetic clutch mechanism 40 falls into the off condition. Accordingly, in the abnormal operation of the throttle valve 11, if the accelerator pedal 34 is released from the depression, the throttle valve 11 is returned to the closed position, and the engine output is reduced.

Further, in the case where the motor 50 or the controller 100 in the present embodiment becomes inoperative, if the accelerator pedal 34 is depressed in excess of a predetermined amount to thereby rotate the arm portion 36*b* of the first rotating member 36 toward the pin 23 of the second rotating member 21, the arm portion 36*b* comes into engagement with the pin 23 as is apparent from FIGS. 1 and 2.

Consequently, the movable yoke 43 may be driven to open the throttle valve 11 to ensure a certain opening as shown by "a" in FIG. 4. As a result, the driver is able to drive the vehicle continuously, though at a low speed.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A throttle control device for controlling an opening of a throttle valve disposed in a throttle body and rotatably supported by a throttle shaft mounted thereon, in response to operation of an accelerator operating mechanism, comprising:

throttle operating means connected to said throttle valve for opening and closing said throttle valve;

first driving means connected to said accelerator operating mechanism and arranged to engage with said throttle operating means for driving said throttle operating means in a direction to open said throttle valve, said first driving means driving said throttle operating means within a predetermined displacement in response to operation of said accelerator operating mechanism when said first driving means is engaged with said throttle operating means;

biasing means mounted on said throttle body for biasing said throttle operating means in a direction to close said throttle valve;

second driving means rotatably mounted on said throttle shaft for driving said throttle operating means in a direction to open and close said throttle valve independently of said first driving means;

a driving power source connected to said second driving means for driving said second driving means in response to operation of said accelerator operating mechanism at least; and clutch means disposed between said throttle operating means and said second driving means for selectively taking one of a first position of said throttle operating means engaged with said second driving means and a second position of said throttle operating means disengaged therefrom, said second driving means being disposed between said clutch means and said driving power source.

2. A throttle control device as set forth in claim 1, wherein said clutch means comprises a fixed yoke attached to said throttle body around said throttle shaft, a movable yoke secured to said throttle shaft in opposed relationship with said fixed yoke, and a coil wound on said fixed yoke for exciting said fixed yoke and said movable yoke, and wherein said second driving means comprises a driving member rotatably mounted on said throttle shaft in parallel spaced relationship with said movable yoke, said driving member engaging with said movable yoke to rotate together around said throttle shaft when said movable yoke is excited.

3. A throttle control device as set forth in claim 2, wherein said first driving means comprises an accelerator shaft rotatably mounted on said throttle body in parallel with said throttle shaft and a first rotating member secured to said accelerator shaft, and wherein said throttle operating means includes a second rotating member rotatably mounted on said accelerator shaft in opposed relationship with said first rotating member and arranged to gear with said movable yoke, said first rotating member being arranged to engage with said second rotating member through engaging means for allowing said first rotating member engage with said second rotating member and rotate said movable yoke in a direction to open said throttle valve.

4. A throttle control device as set forth in claim 3, wherein said engaging means comprises a pin fixed to said second rotating member for extending toward said first rotating member, and an arm portion formed in said first rotating member for extending radially from an axis of said accelerator shaft, said arm portion being formed in spaced relationship with said pin at initial positions of said first rotating member and said second rotating member.

5. A throttle control device as set forth in claim 3, wherein said biasing means comprises a return spring disposed between said throttle body and said second rotating member.

6. A throttle control device as set forth in claim 3, wherein said second rotating member includes a sector portion radially extending from the axis of said accelerator shaft, said sector portion being provided with teeth at an outer peripheral surface thereof to mesh with teeth formed around an outer peripheral surface of said movable yoke.

7. A throttle control device as set forth in claim 6, wherein said second rotating member includes a disc portion with the center thereof rotatably mounted on said accelerator shaft, said disc portion of said second rotating member having a large diameter portion and a small diameter portion to form a stepped peripheral surface, and wherein said first rotating member includes a disc portion with the center thereof secured to said accelerator shaft, said disc portion of said first rotating member having a large diameter portion which is equal in diameter to said large diameter portion of said second rotating member and a small diameter portion to form a stepped peripheral surface, said large diameter portion of said second rotating member being positioned to overlap with said small diameter portion of said first rotating member at the initial positions of said first rotating means and said second rotating members.

8. A throttle control device as set forth in claim 7, further comprising a limit switch which includes a pair of leads disposed in parallel with the outer peripheral surface of said first rotating member and provided with a contact respectively to form opposed contacts, one of said leads being biased to contact the peripheral surfaces of said disc portions of said first and second rotating members, whereby said opposed contacts are closed when at least one of said large diameter portions of said first rotating member and said second rotating member contacts said one of said leads.

9. A throttle control device as set forth in claim 8, wherein said coil of said clutch means is connected to an electric source through a first circuit and a second circuit in parallel therewith, and wherein said limit switch is disposed in said second circuit to open and close said second circuit in accordance with a relative position between said leads.

10. A throttle control device as set forth in claim 9, further comprising an electronic controller having first switching means disposed in said first circuit and second switching means disposed between said limit switch and said electric source in said second circuit, said first switching means being turned on for operation of an automatic speed control by said electronic controller, and said second switching means being turned on for normal operation.

11. A throttle control device as set forth in claim 10, wherein said driving power source includes an electric motor having a rotary shaft geared with said driving member, said electronic controller being connected to said electric motor for controlling operation of said electric motor.

* * * * *